US005320148A

United States Patent [19]

Asciutto

[11] Patent Number: 5,320,148

[45] Date of Patent: Jun. 14, 1994

[54] FUEL NOZZLE BELLOWS RETAINER

[76] Inventor: Joseph Asciutto, 1718 E. Madison Ave., El Cajon, Calif. 92109

[21] Appl. No.: 78,874

[22] Filed: Jun. 21, 1993

[51] Int. Cl.[5] ..... B65B 57/06

[52] U.S. Cl. ..... 141/392; 141/391; 141/286; 141/59

[58] Field of Search ..... 141/285, 286, 391, 392, 141/1, 59

[56] References Cited

U.S. PATENT DOCUMENTS 3,840,055 10/1974 Wostl et al. ..... 141/392 X
3,866,636 2/1975 Lasater ..... 141/392 X
5,238,036 8/1993 Bunce ..... 141/392

*Primary Examiner*—Ernest G. Cusick
*Attorney, Agent, or Firm*—Gilliam, Duncan and Harms

[57] ABSTRACT

A retaining clip which maintains the bellows on a vapor recovery liquid dispensing system in a retracted position while fuel is pumped from the fueling tube of the vapor recovery liquid dispensing nozzle.

7 Claims, 2 Drawing Sheets

FUEL NOZZLE BELLOWS RETAINER

BACKGROUND OF THE INVENTION

1. Field of the Invention

This invention relates to liquid dispensing nozzle assemblies which incorporate a vapor recovery collecting means. More particularly, it relates to a means for retaining the spring biased vapor recovery bellows incorporated on a liquid dispensing nozzle in a collapsed position to allow the use of the liquid dispensing nozzle assembly to fill containers not designed to accommodate and seal the distal end of a vapor recovery bellows.

2. Prior Art

In their efforts to meet the air quality standards set by the United States Government and various State agencies, many urban areas of the United States and more specifically the entire state of California, now require retailers of gasoline and some other hydrocarbon liquids to fit the liquid dispensing nozzle with a vapor recovery system. To that end, retailers of gasoline and other easily evaporated hydrocarbon based liquids, in areas of the United States with government mandated vapor recovery requirements, have fitted their liquid dispensing pumps with nozzles incorporating a means to seal and provide a recovery passage around the liquid or fuel dispensing nozzle and the mouth of a fuel tank to be filled by the liquid dispensing nozzle.

U.S. Pat. No. 3,866,636 (Lasater), U.S. Pat. No. 3,840,055 (Worst) are common examples of the numerous vapor collection fuel nozzles currently in use which operate in similar manners through the use of a vapor collection means consisting of a flexible bellows sleeve which surrounds the spout or liquid outlet means of the dispensing nozzle and is spring biased to extend near the fuel outlet means. During the fueling operation the flexible bellows sleeve is sealed to the opening or fillpipe of the fuel tank. The result being that as the tank is filled with fuel by the dispensing nozzle, the vapors which normally would escape into the earth's atmosphere using a non vapor recovery system, are trapped in the vapor collection means and returned to the reservoir tank from which the liquid was pumped. As taught in U.S. Pat. No. 3,840,055 (Wostl), when not in use, the vapor recovery system of the nozzle is commonly sealed off from the outside atmosphere through the use of an annular sealing ring mounted on the filling tube portion of the nozzle which provides an shoulder upon which the flexible bellows seals internally trapping vapors inside the recovery system. The annular ring doubles as a retaining device which clips under the lip of the fueling pipe when inserted into the fueling pipe during fueling of the tank. There are similar such rings, knobs, and clips on the majority of fuel dispensing nozzles in use in the United States whether used for retaining of the nozzle in the fill pipe of the fuel tank or for sealing the vapor recovery system when the nozzle is not in use.

One problem which has occurred in attempting to minimize vapor loss during the dispensing of liquid by the dispensing nozzle involves the fact that a constant pressure to sufficiently compress the bellows portion against the spring bias must be maintained between the front lip of the vapor recovery bellows and the top of the fillpipe of the fuel tank. If the user fails to maintain pressure to adequately compress the vapor recovery bellows to maintain a seal with the top of the fuel tank fillpipe the fuel pumping device which feeds the fueling nozzle on many such vapor recovery nozzles, will sense the loss of compression through a sensing means and will cause the pumping device for the liquid to cease to operate. Many users of such vapor recovery nozzles, especially in the modern era of self service fueling stations, lack the physical strength to maintain the pressure required for continued retraction of the spring loaded bellows vapor recovery device for a sufficient time to fill their fuel tanks.

Another problem encountered by users of vapor recovery fueling systems involves the location of fillpipe. Automotive fuel tank fillpipes are situated in a great many locations on the hundreds of different vehicle models available in the United States. Some locations are well designed to use the bellows style vapor recovery nozzles while others make it almost impossible for the user to insert the fueling nozzle into the fuel tank fillpipe and maintain the required pressure to retract the bellows and maintain a seal between the fillpipe and the vapor recovery bellows sufficient to allow the pump to operate properly.

A still further problem involves the use of a vapor recovery fuel dispensing nozzle on a fuel tank or container not designed for such a fuel dispensing system. Many older vehicles in the Untied States were built prior the more modern stringent vapor recovery standards now in place. Consequently the fuel tanks on such vehicles were not designed by their manufacturers for a vapor recovery means which seals over the fillpipe. The result of the use of a vapor recovery fuel dispensing nozzle on such fillpipes can be the formation of a vacuum in the fuel tank from the vapor recovery bellows wish attaches to the fillpipe of the fuel tank and removes atmospheric pressure from the tank, or, more seriously, the formation of high pressure in the fuel tank as a result of the pumping of liquid into the closed fuel tank and the improper seal of the vapor recovery bellows over the fill pipe which can cause a blockage for escaping gasses. This can result in a backwash of fuel on the user and the vehicle upon the removal of the nozzle, or, more seriously the complete rupture of the fuel tank and the contents of highly flammable liquids being spewed from the tank.

A further and most vexing problem encountered with the use of vapor recovery type fuel nozzles occurs when the user attempts to fill common portable gasoline container or a portable spring loaded safety fuel container. The most common of such containers have thin walls, and a one to five gallon capacity. Such portable containers are used to transport fuel to small gasoline engine or diesel engine powered devices such as lawn mowers and generators. Such portable containers are capped by a simple screw on type cap or in the case of safety spring loaded containers, a spring loaded cap must be removed by gripping a trigger mechanism by hand on the can which raises the cap off the fillpipe of the fuel container.

Vapor recovery nozzles, when used with portable fuel tanks and other fuel containers not designed for use with a vapor recovery nozzle, pose the user with a dilemma. Most modern fueling nozzles have a sensor located at their tip which shuts off the fuel pump when that senor senses liquid touching the tip of the nozzle. This is a safety device to insure the tank does not overflow during fueling. To maintain the bellows in the collapsed position required by bellows senors in the nozzle requires the user to insert the tip of the nozzle into the small portable fuel container to a point where the nozzle tip is so far inside the container that the nozzle tip liquid senor shuts the nozzle off when the fuel rises in the container and touches the nozzle tip. Unfortunately, on small one and two gallon containers, the container is only partially full when the liquid rises to the point the nozzle tip sensor erroneously signals the container is full and shuts off the pump. The user at this point, if he has sufficient body strength, can collapse the bellows by hand pressure and try to hold the nozzle tip above the container in a steady state for a sufficient time to fill the container. However, most gas station patrons lack sufficient body strength to accomplish this strenuous task for sufficient time to fuel the container especially in the awkward or contorted body position it requires.

On the aforementioned spring loaded safety containers, the user is especially challenged as he must grip the trigger mechanism on the can with one hand to open the container fillpipe while at the same time he must push the bellows against the fillpipe of the safety can with the other hand with sufficient pressure for the bellows senor to allow fueling. Safety cans too suffer inadequate filling when the fuel rises inside the container to a point that the nozzle tip liquid sensor erroneously shuts off the pump.

A further problem can develop on such portable fuel containers if no venting system is designed into such a container to allow for the vapor recovery system on the fueling nozzle to extract vapors from the atmosphere contained in the container. The result again is frustration of the user with the resulting cease of operations by the pump, or the collapse of the walls of the small container from the negative atmosphere which can develop.

A more serious problem which occurs using portable fuel containers with vapor recovery nozzles is the possible rupture of the container wall should high pressure develop as a result of the fuel being pumped into the container and the bellows improperly sealing around an ill designed fillpipe and blocking escaping gases. The resulting failure to allow the escape of any vapors or air from the container can cause the build up of internal atmospheric pressure in the container resulting in the rupture of its walls or the spewing of a geyser of fuel on the user when the fueling nozzle is removed.

Another problem which develops in the fueling of motorized vehicles using a vapor recovery fuel nozzles occurs in the fueling of boats and other motor powered vehicles with a fuel tank fillpipe not designed to accommodate the bellows style vapor recovery means surrounding the fuel nozzle tip of such fuel dispensing devices. As an example, pleasure boats normally have a very small diameter fillpipe aperture which does not accommodate the vapor recovery bellows in an adequate fashion to allow proper ventilation of the fuel tank during the fueling operation. Depending on how the fueling nozzle tip is inserted and how the bellows comes to rest on the hull, the result can be a ruptured fillpipe from internal tank pressure which can develop or backwash of gasoline upon the user and the boat upon the removal of the fuel nozzle, or, the collapse of the tank if a vacuum develops from the bellows extraction of tank atmosphere.

SUMMARY OF THE INVENTION

In summary, the present invention comprises means for retaining the flexible bellows sleeve which surrounds the spout of a vapor recovery fuel dispensing nozzle in a compressed condition.

The preferred material for the invention is non ferrous metal or a plastic that is inert when in contact with hydrocarbon liquid fuels and prevents sparking.

An object of this invention is to allow for the operation of vapor recovery fuel nozzles on fuel tank fill pipes without the need for constant pressure being applied by the user while still allowing for the recovery of escaping vapors.

Another object of this invention is to allow for the use of fuel vapor recovery nozzles on fuel tank fillpipes which are located on a motor vehicle in a manner which precludes the application of pressure in a manner that will allow operation of the nozzle for sufficient time to fuel the vehicle.

Another object of this invention is to allow for the use of fuel vapor recovery style nozzles on the many older vehicles in the United States which were not designed by their manufacturers to be fueled by a nozzle with a vapor recovery means which seals over the fuel tank fillpipe and nozzle tip.

Another object of this invention is to allow the use of fuel vapor recovery nozzles in the fueling of portable fuel containers where no venting system is designed into such a container to allow for the vapor recovery system on the fueling nozzle to extract vapors from the atmosphere contained in the container.

Another object of this invention is to allow the easy use of fuel vapor recovery nozzles in the fueling of spring loaded safety portable fuel containers.

Another object of this invention is to allow the use of fuel vapor recovery liquid dispensing nozzles in the filling of small fuel containers which lack venting to outside atmospheric pressure to vent internal pressure which develops from the pumping of fuel into the container when a vapor recovery bellows covers such fillpipe. The us of this invention will diminish the risk of rupture of the container wall or the back wash of fuel upon nozzle removal should high pressure develop as a result of the fuel being pumped into the container.

Yet another object of this invention is to allow the use of fuel vapor recovery type liquid dispensing nozzles in the fueling of motor vehicles with fuel tanks having fillpipes no designed for such nozzles, such as small boats and motorcycles again avoiding the dangerous backwash of fuel or fuel tank rupture from internal pressure, or, the collapse of the tank from possible vacuum developing depending upon the fillpipe and venting configurations.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENT OF THE INVENTION

Figure 1:
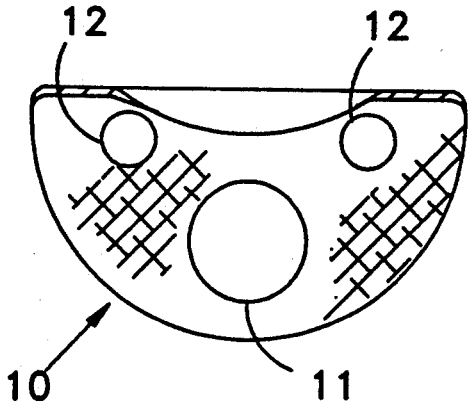
FIG. 1 is front view of the first embodiment of the invention.
Figure 2:
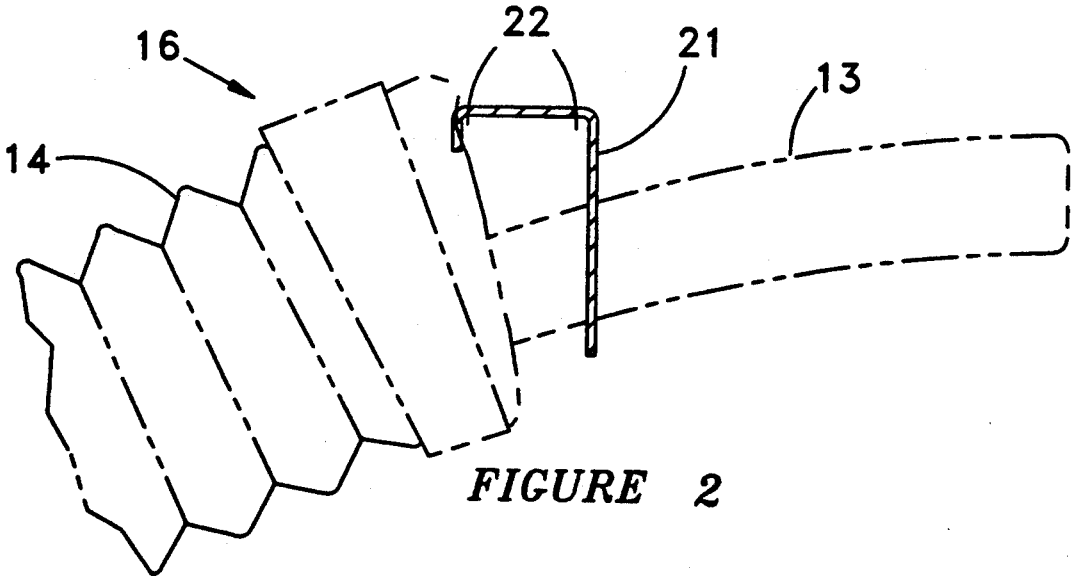
FIG. 2 is a side view of FIG. 1 showing the dispensing nozzle of a vapor recovery liquid dispensing nozzle inserted through the invention.

Referring now to the drawing figures:

Referring specifically to drawing perspective FIG. 1 and FIG. 2. FIG. 1 is a perspective view of the invention illustrating a bellows retaining clip 10 with an aperture 11 of sufficient size to accommodate the fueling tube 13 of a vapor recovery fuel nozzle 16 wherein the tube portion of the nozzle is inserted into the aperture 11 from the side of the retaining clip as viewed in FIG. 2. FIG. 2 depicts two bends 22 in this embodiment of the invention each of substantially 90 degrees.

In operation the invention compresses the spring (not shown) of spring biased bellows 14 of a vapor recovery fuel nozzle. The spring biased bellows places pressure upon the retaining clip 10 pushing the angled lip portion 2 of the retaining clip with sufficient pressure to create sufficient binding friction between the outside of the fueling nozzle 1 and the inside diameter of the aperture 11 to maintain the bellows in a compressed spring bias position during operation of the fuel nozzle. Venting apertures 12 allow for the recovery of escaping vapors into the vapor recovery passage of the bellows 14. The number and size and location of the vent apertures 12 will vary in a manner to be sufficient to allow for proper vapor recovery during operation of the vapor recovery liquid dispensing nozzle.

Figure 3:
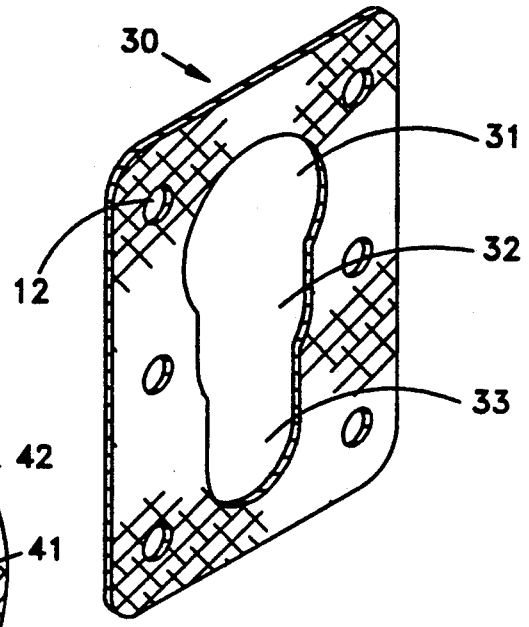
FIG. 3 is a perspective view of a second embodiment of the invention in a flat rectangular form.

FIG. 3 is a perspective view of a flat clip embodiment 30 of the invention for use with vapor recovery nozzles possessing an angular sealing ring or retaining clip 44 mounted on the fueling tube portion 13 of the nozzle. In use, the fueling tube portion 13 (see drawing 4) is inserted into the slotted aperture 31 of a plurality of staged diameters past the point on the fueling tube 13 (see drawing 4) where the annular ring or fillpipe retaining clip 44 is located. The fueling tube 13 is then slid from the larger diameter portion of the slotted aperture 31 to a small diameter portion of the slotted aperture 32 or 33 such that the vapor recovery bellows is maintained in a compressed position. The pressure of the spring loaded bellows forces the clip 30 to stop against the annular ring or the fillpipe retaining clip 44 on a standard vapor recovery nozzle since the annular ring or retaining clip 44 has a larger diameter then the slotted portion of the aperture 32 or 33. The number and size and location of the apertures 31, 32 and 33 will vary in a manner to be accommodate standard diameter fueling tubes 13. To allow for proper vapor recovery during operation of the vapor recovery liquid dispensing nozzle a plurality of venting apertures 12 of a diameter to adequately allow for fuel tank venting, will be in locate in a manner to allow for vapor recovery during the fueling operation.

Figure 4:
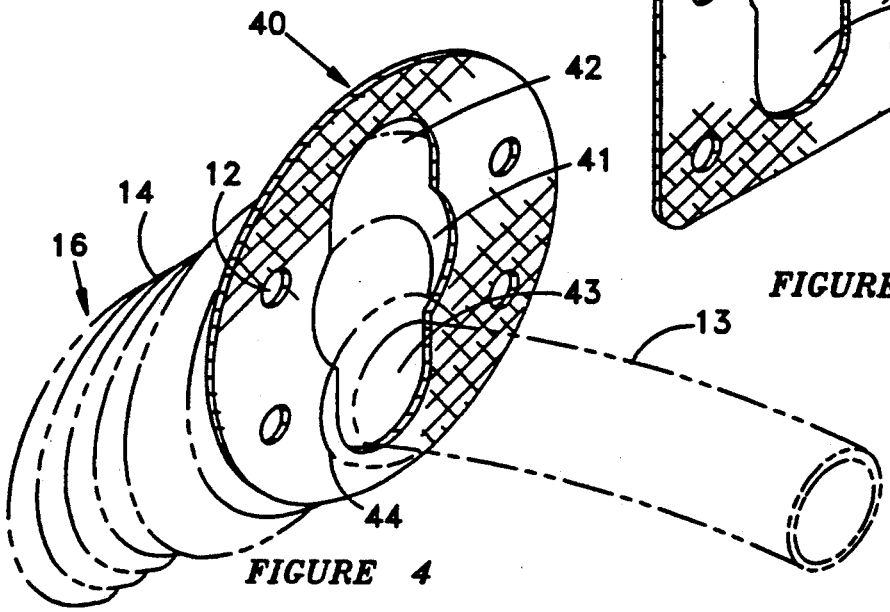
FIG. 4 is a perspective view of a third embodiment of the invention.

FIG. 4 is a perspective view of a flat circular shaped embodiment 40 of the invention for use with vapor recovery nozzles possessing an angular sealing ring or retaining clip 44 on the fueling tube 13. In use, the fueling tube 13 of the fuel dispenser is inserted into the center of the slotted aperture of staged diameters 41 past the point on the fueling tube where the annular ring or fillpipe retaining clip 44 is located. The fueling tube 13 is then slid from the larger diameter portion of the slotted aperture 41 to a small diameter portion of the slotted aperture 42 or 43 such that the vapor recovery bellows 14 (see FIG. 2) is maintained in a collapsed position when the pressure of the spring loaded bellows forces the clip to stop against the annular ring or retaining clip 44 on the fueling tube 13. The number and size and location of the apertures 41, 42 and 33 will vary in a manner to accommodate standard diameter fueling tubes 13. The number and size and location of the aperture 12 will vary in a manner to be sufficient to allow for vapor recovery during operation of the vapor recovery liquid dispensing nozzle.

Figure 5:
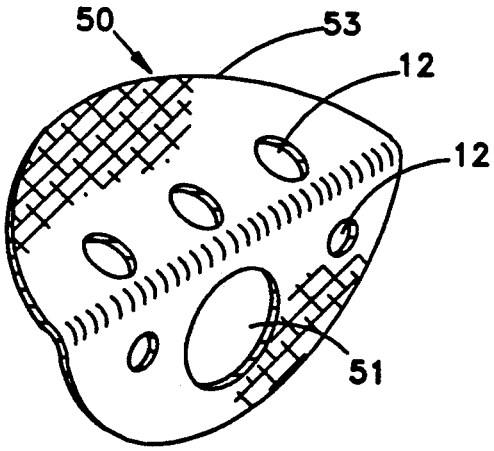
FIG. 5 is a perspective view of a fourth embodiment of the invention.

FIG. 5 is a one angle embodiment 50 of the invention with a aperture 51 of sufficient diameter to slip past the annular ring or fillpipe retaining clip 44 (see FIG. 4) located upon the fueling tube 13. The clip 50 with the nozzle tip 13 inserted into the aperture 51 is slid back to a position on the fueling tube 13 against the spring bias, to a point where the bellows 14 are retracted sufficiently to allow the pump to operate. The bellows 14 in a retracted position places pressure on the clip 50 and forces the opposing edge of the clip 53 to exert sufficient binding friction upon the fueling tube to maintain the bellows in a collapsed position. The number and size and location of the venting apertures 12 will vary in a manner to be sufficient to allow for vapor recovery during operation of the vapor recovery liquid dispensing nozzle.

While all of the fundamental characteristics and features of the invention have been shown and described, it should be understood that various substitutions, modifications, and variations may be made by those skilled in the art without departing from the spirit or scope of the invention. Consequently, all such modifications and variations are included within the scope of the invention a defined by the following claims.

What is claimed is:

1. In combination with a vapor recovery system fuel dispensing mechanism including a fuel dispensing tube and a spring biased bellows surrounding said dispensing tube, said bellows must be retained in a bias compressed configuration for fuel to be dispensed from said dispensing tube, a clip means for retaining the bellows in said bias compressed condition comprising:

said clip means having a greater cross-sectional area than the cross-sectional area of said spring biased bellows, said clip means having at least one venting aperture therethrough and at least one dispensing tube aperture therethrough of a diameter slightly larger than the diameter of said fuel dispensing tube, so that when said fuel dispensing tube is inserted into said at least one dispensing tube aperture and said clip means is slid along the outer surface of said dispensing tube against said spring biased bellows the clip means forces said spring biased bellows into a compressed condition so that when said clip means is then slowly released said spring biased bellows presses against said clip means frictionally binding said clip means against said dispensing tube thereby holding said spring biased bellows in said compressed condition whereby fuel can be dispensed.

2. The invention as defined in claim 1 wherein said fuel dispensing tube includes an external protrusion spaced from a dispensing end and said clip means includes at least two different diameter interconnecting dispensing tube apertures a first one of said at least two dispensing tube apertures having a diameter sufficient to pass over said dispensing tube and said protrusion and a second one of said at least two dispensing tube apertures having sufficient diameter to only pass over said tube when the dispensing tube is inserted into said at least two dispensing tube apertures a sufficient distance to compress said spring biased bellows until said clip means passes over said protrusion, at this location the clip means is translated so that said second dispensing tube aperture now surrounds said dispensing tube locking said clip means against said protrusion holding said bellows in a compressed position.

3. The invention as defined in claim 2 wherein said clip means includes a third different diameter dispensing tube aperture interconnected with said first and said second dispensing tube apertures whereby said clip means can be used on at least two different diameter dispensing tubes with protrusions.

4. The invention as defined in claim 2 wherein said protrusion is a shoulder around the dispensing tube.

5. The invention as defined in claim 1 wherein said clip means is formed of non-ferrous metal.

6. The invention as defined in claim 1 wherein said clip means is formed of plastic.

7. The invention as defined in claim 1 wherein opposing sides of said clip means are bent toward each other.

* * * * *